US006352405B1

(12) United States Patent
Tomko

(10) Patent No.: US 6,352,405 B1
(45) Date of Patent: Mar. 5, 2002

(54) INTERCHANGEABLE TURBINE DIAPHRAGM HALVES AND RELATED SUPPORT SYSTEM

(75) Inventor: Andrew John Tomko, Glenville, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/635,314

(22) Filed: Aug. 9, 2000

(51) Int. Cl.[7] ..... F04D 29/60
(52) U.S. Cl. ..... 415/209.2; 415/213.1
(58) Field of Search ..... 415/209.2, 126, 415/213.1, 214.1, 138, 201

(56) References Cited

U.S. PATENT DOCUMENTS 2,919,891 A * 1/1960 Oliver ..... 415/136
3,861,827 A * 1/1975 Peabody et al. ..... 415/219
4,204,803 A 5/1980 Leger et al. ..... 415/219 R
5,743,711 A 4/1998 Fournier et al. ..... 415/209.2

* cited by examiner

*Primary Examiner*—Edward K. Look
*Assistant Examiner*—Richard Edgar
(74) *Attorney, Agent, or Firm*—Nixon & Vanderhye P.C.

(57) ABSTRACT

A turbine diaphragm adapted to be supported in a lower turbine shell component includes a first diaphragm half portion having a pair of diametrically opposed horizontal joint surfaces and a second diaphragm half portion having a similar pair of diametrically opposed horizontal joint surfaces. The first and second diaphragm half portions are identical and interchangeable. Each diaphragm half portion is formed with mounting slots for receiving a support bar engageable with the lower turbine shell component, and with identical joint bolt holes to thereby insure interchangeability of the first and second diaphragm half portions.

20 Claims, 1 Drawing Sheet

INTERCHANGEABLE TURBINE DIAPHRAGM HALVES AND RELATED SUPPORT SYSTEM

This invention relates to turbomachinery and, specifically, to a system for supporting interchangeable upper and lower halves of a split, annular diaphragm radially in the steam path of a steam turbine.

BACKGROUND OF THE INVENTION

Turbomachines generally comprise stationary and rotating parts defining a flow path for fluid through the turbine. Turbomachines also include an outer fluid tight caging called an outer shell from which a number of stationary parts, including split, annular diaphragms (that mount the fixed nozzles between the stages of the turbine), generally depend radially inwardly. In some prior arrangements, the diaphragms are positioned by radial keys (at the 6 and 12 o'clock positions) and are supported by support bars on opposite sides (in 9 and 3 o'clock positions) of the diaphragms.

The outer shell or casing may also be split along a horizontal joint so that the turbine shell comprises an upper half and a lower half. In building a turbomachine, certain stationary parts are mounted in the lower half shell whereas other stationary parts are mounted in the upper half shell while the two mating components are kept apart. The two halves are then assembled along a horizontal joint after the rotor has been mounted in the lower half.

As already noted, the diaphragms may likewise be split along a horizontal joint and comprise upper and lower diaphragm halves. The lower diaphragm halves are each mounted in the lower half shell, and after rotor installation, the upper diaphragm halves are bolted to the lower diaphragm halves. It is necessary, however, to align the diaphragm with the rotor to insure a uniform and desired radial gap between them.

Traditionally, large diaphragms have been supported radially by pads bolted to the sides of the lower half diaphragm, and supported by the lower turbine shell. The current design uses a rectangular slot and bolts to fasten the diaphragm support or pad to the diaphragm. With higher turbine power density designs in fixed outer shells, however, the available space for current supporting systems has become problematic. Supporting blocks or pads, hold down bolts, sealing keys and lifting holes, etc. all vie for the limited space.

In addition, with current designs, alignment of the diaphragms can only be achieved by removing the rotor from the shell. In addition, the lower halves of diaphragms are the last major maintenance component to be received, and the first to be reinstalled after repair. Current designs simply do not address serviceability concerns. There is thus a need for simplified diaphragm construction that reduces alignment time, errors, and minimizes crane usage for rotor removal, and that facilitates serviceability.

BRIEF SUMMARY OF THE INVENTION

This invention provides a new system for supporting steam turbine diaphragms radially within the steam path. It also provides diaphragm alignment capability without removing the rotor from the casing. The new support system includes a support bar that incorporates a dovetail for mating engagement with a dovetail slot in the outer ring of the lower diaphragm half that carries the load and maintains radial position. This arrangement is provided on both sides of the diaphragm.

Specifically, the support bar in accordance with one exemplary embodiment of the invention includes a vertical body portion with an outwardly directed support flange at an upper end thereof, and an inwardly directed dovetail adjacent a lower end thereof. The supporting flange is adapted to engage a shoulder of the lower casing half via a plurality of adjustment shims, a shim pack clamping block, and a shim pack clamping bolt. The shims are employed to align the diaphragm as necessary, relative to the rotor. The dovetail is engaged with, or seated within, a mating dovetail slot formed in the diaphragm lower half, adjacent the split line (between the upper and lower diaphragm halves).

A set screw approximately mid-way along the support bar is used to stabilize the support bar relative to the lower diaphragm half, while an additional set screw extends through the dovetail itself, bearing on the base of the dovetail slot, thus enabling the dovetail joint to be securely locked.

In the exemplary embodiment, the upper and lower diaphragm halves are also made identical, so that each diaphragm half can be used as either the upper or lower half component. Thus, dovetail slots are formed in identical locations on both diaphragm halves so that the support bar described above will have a mating dovetail slot in whichever diaphragm half is used as the lower half. Similarly, the clamping bolt holes and bolt access arrangements for the support bars, as well as the joint bolts and bolt holes for securing the upper and lower diaphragm halves are also made identical.

The above described dovetail design eliminates the bolts and drilled holes in the outer ring of the diaphragm, and provides additional advantages with respect to design simplicity, flexibility, quicker and more accurate alignment, and decreased maintenance. Moreover, the design provides immediate servicing of the upper half of the diaphragm without waiting for the lower half to be removed. At the same time, the interchangeability feature permits assembly and alignment of the upper diaphragm halves in the lower position, again shortening outage duration. In addition, the direct alignment of turbine rotors with the stationary components (diaphragms) in the turbine shell, avoids alignment errors caused by translating data from other alignment techniques.

In its broader aspects, the present invention relates to a turbine diaphragm adapted to be supported in a lower turbine shell component comprising a first diaphragm half portion having a pair of diametrically opposed horizontal joint surfaces; a second diaphragm half portion having a similar pair of diametrically opposed horizontal joint surfaces; the first and second diaphragm half portions being identical, including identical mounting slots for receiving a support bar engageable with the lower turbine shell component to thereby insure interchangeability of the first and second diaphragm half portions.

BRIEF DESCRIPTION OF THE DRAWINGS

The FIGURE is as partial cross-section illustrating a support system for a steam turbine diaphragm in accordance with the invention.

DETAILED DESCRIPTION OF THE INVENTION

Figure 1:
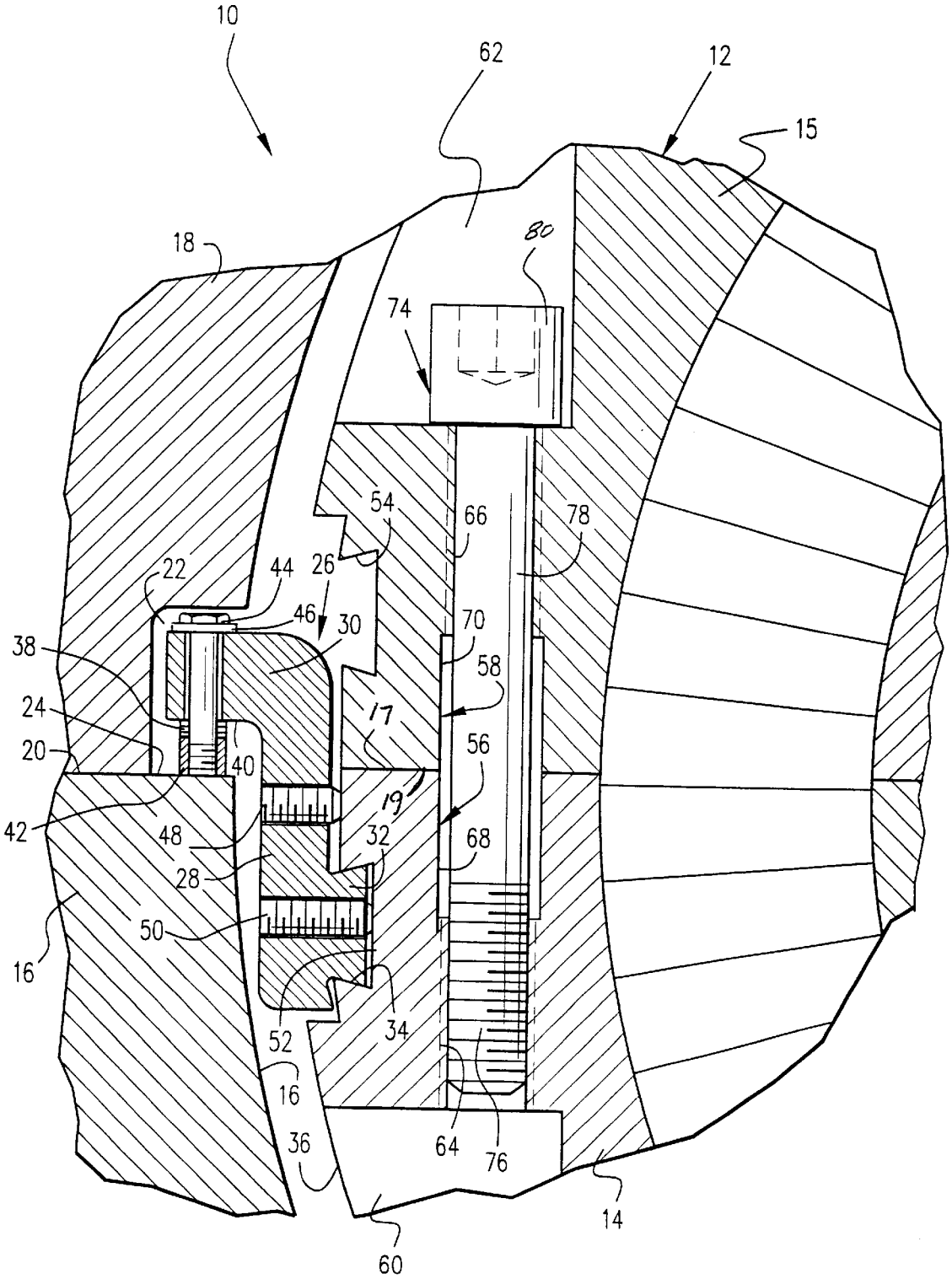

The FIGURE illustrates a support and assembly system 10 for a steam turbine diaphragm 12, and specifically for the lower half 14 and upper half 15 of a split diaphragm, each of which has a pair of opposed, horizontal joint surfaces 17, 19 (only one of each pair shown). The lower diaphragm half 14 is positioned within a lower turbine shell component 16, partly shown. An upper turbine shell component 18 is also partly shown, with a split line 20 at the juncture of the upper and lower shells. Thus, the split line 20 also refers to the matching horizontal joint surfaces of the upper and lower shells. The upper shell 18 includes a recess or pocket 22 that facilitates the use of a horizontal edge portion 24 of the lower shell 16 along the split line 20 for supporting the diaphragm. In this regard, it will be appreciated that the upper diaphragm half 15 is supported on, and bolted to, the lower diaphragm half 14, along a pair of opposed horizontal joint surfaces, after the lower diaphragm half 14 and rotor have been installed in the lower shell 16.

A diaphragm support bar 26 in accordance with an exemplary embodiment of this invention includes a vertical body portion 28 having a 90°, outwardly directed support flange 30 at its upper end, and a 90°, inwardly projecting dovetail 32 adjacent its lower end. The dovetail 32 is adapted for mating engagement within a dovetail slot 34 formed in the outside surface 36 of the lower diaphragm half 14. The upper support flange 30 projects into the pocket 22, enabling the lower diaphragm half 14 to be supported on the lower shell 16, along the split line 20. In addition, one or more shims 38 (also referred to as a "shim pack") are sandwiched between a lower surface 40 of the flange 30 and a shim pack clamping block 42 supported directly on the horizontal edge portion 24 of the lower shell 16. A shim pack clamping bolt 44 (with one or more washer shims 46 to adjust hold down clearance) extends through the flange 30 and into a threaded bore in the clamping block 42. With the lower diaphragm half 14 thus supported in the lower shell 16, the rotor (not shown) may be installed. Subsequently, the upper diaphragm half 12 is located on the lower diaphragm half and bolted thereto as described in greater detail below. Thus, both the upper and lower diaphragm halves 14 and 15 are supported by the support bars 26 located on opposite sides of the lower diaphragm half 14.

It will be appreciated that shims 38 can be added or removed to align the diaphragm relative to the rotor. Vertical adjustment can be accomplished by adding or removing a like number of shims 38 from both sides of the diaphragm, whereas side-to-side "rocking" alignment (about a radial pin, not shown, at the 6 o'clock position) of the lower diaphragm half by differential addition or subtraction of shims 38 from the support bar 26 on the opposite side of the diaphragm.

A first set screw 48 extends through the support bar 28 above the dovetail 32 so as to engage the outer surface 36 of the lower diaphragm half 14 and thus set the support bar relative to the lower diaphragm half.

A second set screw 50 extends horizontally through the bar 28 and the dovetail 32 so as to engage the base 52 of the dovetail slot 34. This enables the dovetail joint to be locked securely in the desired position.

In accordance with this invention, the upper diaphragm half 15 is identical to, and thus interchangeable with, the lower diaphragm half 14. Note for example that the upper diaphragm half 15 also includes a dovetail slot 54 formed on the outside of the diaphragm, at the same location relative to the horizontal joint surfaces 20 as the dovetail slot 34 in the lower diaphragm half 14. Dovetail slot 54 is used, however, only in the event diaphragm half 15 is used as a lower diaphragm half.

At the same time, each diaphragm half 14, 15 is formed with a partially threaded bolt holes 56, 58, respectively, on opposite sides thereof (only one shown), accessed by notched areas 60, 62 in the upper and lower diaphragm halves. The bolt holes have threaded bore portions 64, 66 adjacent the respective notched areas 60, 62, with smooth bore portions 68, 70 adjacent the split line formed by the horizontal joint surfaces 17, 19 on the respective diaphragm halves. A joint bolt 74 has a threaded end 76 and a smooth shank portion 78. This arrangement facilitates the interchangeability of the diaphragm halves in that the bolts will always be threadably secured to the lower diaphragm half, clamping the upper diaphragm half 15 between the head 80 of the bolt and the lower diaphragm half 14. These bolts are made slightly longer than conventional joint bolts, with bolt clearance designed around the horizontal joint (or split line 72) to facilitate only one threaded engagement at a time. In other words, the threaded end 76 of the bolt 74 does not engage threaded portion 64 of bore 56 until it passes completely through the threaded portion 66 of bore 58. In this regard, the threaded portions 64, 66 of the respective bores are in the bottom (or top if considering the upper diaphragm half) 60% of the bore, as measured from the horizontal joint surfaces, or split line 72, and the smooth shank portion 78 of the bolt is longer than the threaded end portion 76. This arrangement allows the joint bolts 74 to be symmetrical no matter how the diaphragm halves are oriented, and will allow the same bolts to be used in either direction. Spacing the threads away from the joint surface also prevents the thread from extruding onto the horizontal joint surfaces along the split line 72 when the bolts 74 are tightened.

Once the sealing keys (not shown) are fitted, it becomes irrelevant to which side the keys are to be fastened.

The above arrangement provides interchangeability, reduces design, manufacturing, assembly, alignment and field service costs. It also permits servicing of the upper diaphragm half without removing the lower half and/or rotor.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine diaphragm adapted to be supported in a lower turbine shell component comprising:

a first diaphragm half portion having a pair of diametrically opposed horizontal joint surfaces;

a second diaphragm half portion having a similar pair of diametrically opposed horizontal joint surfaces;

said first and second diaphragm half portions being identical, including identical aligned bolt holes for receiving a joint bolt for securing said first and second diaphragm half portions to each other such that the joint bolt can pass through whichever of said first and second diaphragm half portions is in an upper position and be threaded into whichever of said first and second diaphragm half portion is in a lower position, and identical mounting slots for receiving a support bar engageable with the lower turbine shell component to thereby insure interchangeability of said first and second diaphragm half portions.

2. A turbine diaphragm adapted to be supported in a lower turbine shell component comprising:

a first diaphragm half portion having a pair of diametrically opposed horizontal joint surfaces;

a second diaphragm half portion having a similar pair of diametrically opposed horizontal joint surfaces;

said first and second diaphragm half portions being identical, including identical mounting slots for receiving a support bar engageable with the lower turbine shell component to thereby insure interchangeability of said first and second diaphragm half portions; wherein said mounting slots include dovetail slots in exterior side surfaces of each of said first and second diaphragm half portions.

3. The diaphragm of claim 1 wherein each bolt hole has a threaded bore portion and a smooth bore portion and wherein, when said first and second diaphragm half portion are joined together, said smooth bore portions are adjacent each other.

4. The diaphragm of claim 3 wherein joint bolt has a shank with an unthreaded portion and a threaded portion, the threaded portion located at a distal end of said shank.

5. The diaphragm of claim 2 wherein said dovetail slots are located adjacent said horizontal joint surfaces.

6. The diaphragm of claim 2 in combination with a support bar having a vertical body portion and a dovetail extending substantially perpendicularly from one end of aid body portion and adapted to seat in said dovetail slot.

7. The diaphragm of claim 6 wherein said support bar also includes a support flange at an opposite end of said body portion adapted to be supported by an edge of said lower turbine shell component.

8. The diaphragm of claim 4 wherein said support bar also includes a support flange at an opposite end of said body portion adapted to be supported by an edge of said lower turbine shell component.

9. The diaphragm of claim 7 wherein said support flange is provided with a clamping bolt that threadably engages a shim clamping block below said support flange, with one or more shims between said support flange and said clamping block.

10. A support system for supporting a turbine diaphragm in a lower turbine shell component, the turbine diaphragm including first and second diaphragm half portions joined together along opposed pairs of horizontal joint surfaces, said first and second diaphragm half portions being identical and interchangeable and including dovetail slots adjacent said opposed pairs of horizontal joint surfaces, the support system comprising at least a pair of support bars each having a vertical body portion with a support flange extending substantially perpendicularly from an upper end of the vertical body portion; and a dovetail extending substantially perpendicularly from a lower end of the vertical body portion, said dovetail of each of said pair of support bars adapted to be seated in the dovetail slots in whichever of the first and second diaphragm half portions is utilized as a lower diaphragm half portion.

11. The support system of claim 10 wherein said support flange and said dovetail extend in opposite directions from said vertical body portion.

12. The support system of claim 10 wherein said support flange is provided with a clamping bolt that threadably engages a shim clamping block below said support flange, with one or more shims between said support flange and said clamping block.

13. The support system of claim 10 including a first set screw extending horizontally through said vertical bar portion, axially between said support flange and said dovetail.

14. The support system of claim 13 including a second set screw extending horizontally through said vertical body portion and through said dovetail.

15. The support system of claim 10 including bolt holes in each of said first and second diaphragm half portions, alignable with each other, each bolt hole having a threaded bore portion and a smooth bore portion and wherein, when said first and second diaphragm half portions are joined together, said smooth bore portions are adjacent each other.

16. The support system of claim 15 and including at least one joint bolt having a shank with an unthreaded portion and a threaded portion, the threaded portion located at a distal end of said shank.

17. The support system of claim 16 wherein said unthreaded portion is longer than said threaded portion.

18. The support system of claim 15 wherein said support flange is provided with a clamping bolt that threadably engages a shim clamping block below said support flange, with one or more shims between said support flange and said clamping block.

19. The support system of claim 18 including a dovetail locking set screw extending horizontally through said vertical bar portion and through said dovetail.

20. The support system of claim 18 including a stabilizing set screw extending horizontally through said vertical body portion, axially between said support flange and said dovetail.

* * * * *